United States Patent [19]

Clarke

[11] 4,088,319

[45] May 9, 1978

[54] GAME BALL WITH FLEXIBLE PLASTIC FOAM TAIL

[76] Inventor: William A. Clarke, 3420 Pine Tree Ter., Erie, Pa. 16506

[21] Appl. No.: 795,928

[22] Filed: May 11, 1977

Related U.S. Application Data

[63] Continuation-in-part of Ser. No. 708,743, Jul. 26, 1976, abandoned.

[51] Int. Cl.[2] ..... A63B 43/02

[52] U.S. Cl. ..... 273/58 R; 273/58 C; 273/58 E; 273/58 F; 273/58 K; 273/106 R; 46/52

[58] Field of Search ..... 273/58, 199 R, 199 A, 273/DIG. 8, 106 R, 106 A, 106 B, 106 F; 46/51, 52

[56] References Cited

U.S. PATENT DOCUMENTS

| | | | |
|---|---|---|---|
| 3,198,526 | 8/1965 | Smith et al. | 273/199 A |
| 3,554,543 | 1/1971 | Di Laura | 273/DIG. 8 |
| 3,675,926 | 7/1972 | Misevich | 273/106 B X |

FOREIGN PATENT DOCUMENTS

| | | | |
|---|---|---|---|
| 356,890 | 9/1931 | United Kingdom | 273/199 R |
| 389,243 | 3/1933 | United Kingdom | 273/199 R |

*Primary Examiner*—George J. Marlo
*Attorney, Agent, or Firm*—Ralph Hammar

[57] ABSTRACT

A ball with a tail of flexible plastic foam by which the ball may be thrown or caught. The tail trails the ball in flight and is of cross section great enough to prevent wrapping around or tangling with tree limbs, wires, etc., with which the tail may come in contact during flight.

4 Claims, 5 Drawing Figures

GAME BALL WITH FLEXIBLE PLASTIC FOAM TAIL

This application is a continuation in part of application Ser. No. 708,743, filed July 26, 1976 now abandoned.

This invention is a ball with a low density plastic foam tail by which the ball may be thrown or caught.

On the drawing FIG. 1 is a side view of the ball in flight partly broken away;

Figure 5:
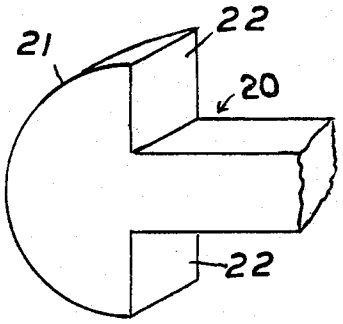

and FIG. 5 is a perspective view of a modification of the tail.

In a preferred form there is a hollow spherical ball 1 of thin walled impact resistant thermoplastic which for example may be made by injection molding, vacuum forming or blow molding and a tail 2 of lightweight open cell flexible thermoplastic foam such as polyurethane. For small children the ball may have an outside diameter of about 2 inches and the tail may be of square cross section $\frac{5}{8}$ to $\frac{3}{4}$ inches on a side and from 18 to 25 inches long. These dimensions are by way of example and not of limitation. Within the ball is a weight 3 such as a ballbearing, a marble or lead weight which is free to move about the interior of the ball. The purpose of the weight 3 is to make the ball several times as heavy as the tail so that the center of gravity of the ball and tall combination will always be within or at least close enough to the ball so the ball will lead the tail in flight.

The ball has several holes 4 which have the purpose of creating a whistling noise as the ball goes through the air. The tail is fastened to the ball by an eyelet or grommet 5 having an external flange 6 of larger diameter than an opening 7 in the ball and having a central opening 8 in the flange of less diameter than the opening 7 through which one end of the tail may be inserted. Integral with the flange 6 is a tubular section 9 having a snug fit in the hole 7.

In the assembly of the tail to the ball, one end 10 of the tail is first inserted through the opening 8 in the eyelet and a short length of the tail, such as an inch or so, is extended beyond the inner end of the tubular section 9. Next a plug 11 is pressed into the tubular section 9 squeezing the tail into the restricted space 12 between the plug 11 and the inner surface of the tubular member 9. This compresses the tail to an extent substantially completely eliminating the voids of the open cell foam. The compression may be still greater than that required to eliminate the voids so long as the elastic limit of the urethane is not exceeded. After the tail has been thus assembled into the grommet 5, the tubular section 9 of the grommet is pressed through the hole 7 in the ball. Integral projections 13 on the outer surface of the tubular section 9 are snapped through the hole 7 and lock the grommet in place. This results in a secure fastening of the tail to the ball which is essentially impossible to break without rupturing the ball.

In the use of the ball, the end 14 of the tail remote from the ball is grasped and the ball is whirled about and the tail is released when the ball is traveling in the desired direction. In flight, the ball precedes the tail and the tail is almost straight. The ball may be thrown in the air and caught by the tail as it comes down on the ball may be thrown to another player who will catch the tail as it goes by.

While the ball is flying through the air at high speed there is a whistling sound as air flows in and out of the openings 4. As the ball slows down, the force of gravity acting through the center of gravity of the ball, tail combination pulls the ball down ahead of the tail since the center of gravity is within the ball. As the ball descends, the tail likewise is essentially straight but is inclined upward from the ball.

Because the foam tail is of large cross section and has a memory or resilience which causes it to spring back to its original shape, it has almost no tendency to tangle with or wrap around wires or tree limbs. The ball almost always falls completely through the trees. If the limbs are so dense that the ball cannot fall through a tree, shaking the tree usually dislodges the ball. Once the ball is dislodged the tail, which is of smaller cross section than the ball, does not interfere.

The ball may be caught by its tail. The foam is soft and bulky and has no tendency to cut the catching hand. A cord or string of similar weight would have a tendency to cut, would be difficult to see, would also have a tendency to tangle or wrap around wires and tree limbs.

By using the tail for whirling the ball and releasing the tail when the ball is rotating at high speed, the distance of flight is increased with respect to the distance obtained by throwing the ball.

As the ball is whirled preparatory to launching, centrigual force causes the weight 3, **3*a* to move radially outward within the ball 1, 1*a*** so the center of gravity of the ball-tail combination is shifted outward and the moment of inertia and the resultant momentum is increased. This causes the hollow ball with the loose weight to travel further than a solid ball of the same size and weight. To maximize momentum, the ball should have a thin light weight shell and a heavy loose weight.

Figure 1:
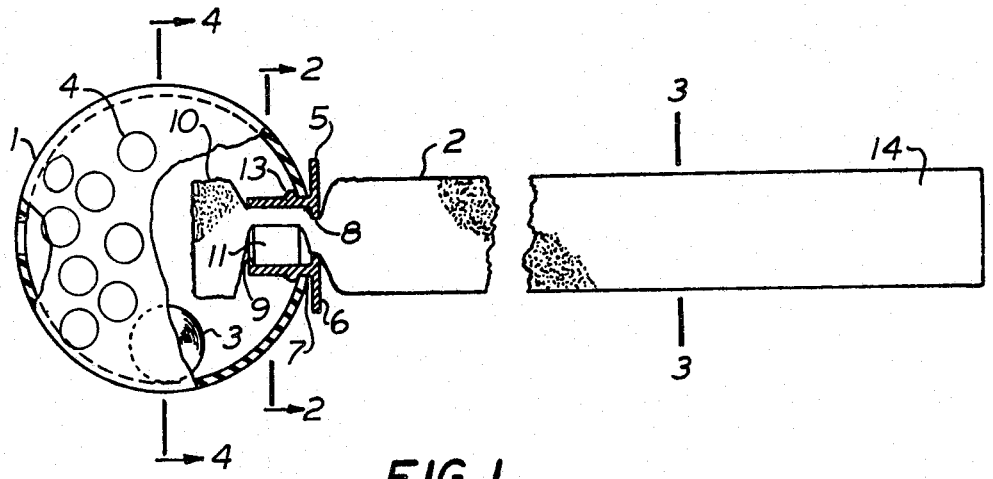
Figure 2:
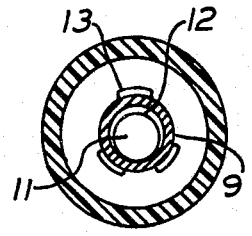
FIG. 2 is a section through the ball on line 2—2 of FIG. 1.
Figure 3:
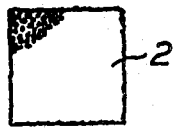
FIG. 3 is a transverse section through the tail on line 3—3 of FIG. 1.
Figure 4:
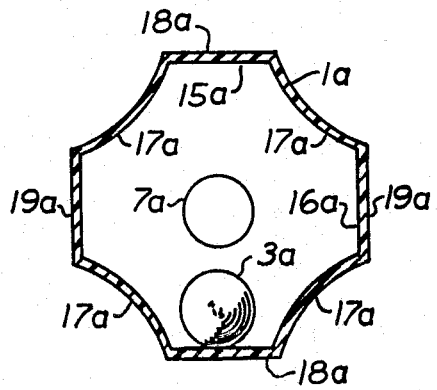
FIG. 4 is a section through another ball on line 4—4 of FIG. 1.

FIG. 4 shows a hollow ball **1*a* functionally equivalent to the ball 1. The ball 1*a* is adapted to blow molding in one piece or to injection molding or vacuum forming in two pieces from impact resistant thermoplastic. The ball is in the shape of two wheel elements 15*a*, 16 at a right angle to each other and fixed to each other by integral concave connecting wall sections 17*a* located in each quadrant. The wheel elements have flat cylindrical rims or tread sections 18*a*, 19*a*. When the ball is made in one piece by blow molding, the loose weight 3*a* is inserted through opening 7*a* while the ball is warm and the cooling shrinkage of the plastic prevents removal of the weight after cooling. When made in two pieces, the ball is inserted before the pieces are joined together. The tail and grommet assembly 2,5 of FIGS. 1–3 may be fastened in opening 7*a* in substantially the same manner as the FIG. 1–3** ball-tail assembly.

Since the ball is used as an aerial object, it does not require the spherical or circular surfaces of a ball. It is not required to roll. Nor is the ball required to be hollow (as shown) or to be made of any particular material. Solid plastic foam balls may be used. There is no technical reason forbidding the use of any material used for children's game balls. Since some children may not catch the ball by its tail, its exterior surface should not be unfriendly. The ball should not be heavy, it is not a missile.

In spite of its softness, the tail is surprisingly strong, and is unbreakable by the forces of throwing and catching.

The extension 10 (FIG. 1) of the tail may be long enough to make a U turn with its free end extending back along the tubular section 9 to the flange 6. Then when the grommet 5 is inserted in the opening, the free end of the tail will be gripped between the section 9 and the edge of the opening 7. With this gripping structure the plug 11 may not be necessary.

In FIG. 5, the tail 20 has an integral enlarged head which when forced through the opening 7 or 7*a* springs back inside the ball 1 or 1*a* and locks the tail in place by shoulders 22. While the tail may be pulled out of the ball, the force required is much greater than required for normal use of the ball so unintentional removal is essentially impossible. If removed, it can be reinstalled. Other means for securing the tail to the body may be used.

There is no advantage in a tail of cross sections larger than 1 inch square. Nor is there any advantage in tails of circular or other non square cross section. Tails of square cross section are conveniently cut from sheets of foam having a thickness equal to one side of the square.

The length of the tail is not limited to 18 to 25 inches. Since the ball is whirled by its tail, lengths longer than 25 inches become increasingly unwieldy for whirling by people of average height. As the length of the tail is decreased below 10 inches the whirling speed must be unreasonably increased to obtain the desired centrifugal force on the ball. At 10 inches and less, another factor enters, namely the inability to catch the ball by its tail. Tail catching requires that the catcher see and catch the tail as it passes by. Most catching is done in the range of 14 to 20 inches from the ball. A skillful player can consistently catch the tail at 16 inches. A beginner may miss the tail or just barely catch it at 25 inches. However, an expert will miss a tail which is less than 10 inches long.

The practical lower limit for the tail length is about 10 inches, both for throwing and for catching. A comfortable tail length for ease of throwing and catching is about 20 inches.

In addition to flexible thermoplastic foam, the tail may be made of other materials having the required light weight flexibility and bulk so as to be easily visible. One such material is carpet binding tape which is ordinarily from $1\frac{1}{4}$ to $1\frac{1}{2}$ inches wide. Another such material is strips of flexible vinyl plastic sheeting. Both of these materials are obtainable in colors which are easily visible and both have the required light weight and flexibility. These materials do not have the plastic memory nor the tendency to return to the original position when deflected. Therefore, these materials have some tendency to tangle with tree limbs and wires although this tangling tendency is nowhere near as great as would be the case if the tail were made of string. The tails of carpet binding tape and flexible plastic strips are harder to see in flight and therefore are slightly more difficult to catch than the tails of plastic foam. Part of this results from the tendency of the carpet tape and plastic to twist or wind as the ball is whirled for throwing to form a loose tubular spiral. This reduces the bulk and results in tail which is more difficult to see. Also there is a tendency of the tail to whip or flutter in flight which is another factor making the tail more difficult to see. The futtering also causes some change in position of the tail. That is, the sidewise motion introduces another factor which must be taken into account in catching the tail. The plastic foam tail remains straight and has substantially no fluttering tendency and is therefore easier to catch which means that the tail can be caught closer to the ball. There appears to be no technical reason why any light weight flexible material could not be substituted for the plastic foam tail. The light weight is required to place the center of gravity within or at least close to the ball so that the tail will follow the ball in flight. The light weight is also required to provide a tail of sufficient bulk so that it can be seen. The ball may be traveling past the catcher at a relatively high rate of speed; and if the tail were stringlike, the catcher would not be able to see the tail in time to catch it.

I claim:

1. A game ball for playing catch having attached thereto an elongated tail of flexible plastic foam having memory or resilience which causes it to spring back to its original shape when deflected and being of light weight relative to the ball so the tail follows the ball in flight, said tail being substantially 10 to 25 inches in length so the ball may be caught while in flight by grasping its tail as the ball moves past the catcher and the ball may be thrown by grasping the end of the tail remote from the ball and whirling the ball about and releasing the tail when the ball is travelling in the desired direction and at the desired speed, and the cross section and bulk of said tail being of such size that said tail has substantially no tendency to tangle with or wrap around objects such as tree limbs with which it may come in contact during flight.

2. The structure of claim 1 in which the ball has a hollow shell and a free weight in the shell.

3. The structure of claim 1 in which the ball has a hollow shell with a grommet receiving opening, a grommet fixed in said opening, said grommet having a bore through which one end of the tail extends and a sleeve of greater diameter than said bore projecting into the shell and a plug in said sleeve wedging the inner end of the tail against the sleeve to fasten the tail to the grommet.

4. The structure of claim 1 in which the ball has a hollow shell with an opening and the tail has a head within the shell of diameter larger than the opening for holding the tail assembled to the shell.

* * * * *